United States Patent [19]

Gray et al.

[11] 4,250,397

[45] Feb. 10, 1981

[54] HEATING ELEMENT AND METHODS OF MANUFACTURING THEREFOR

[75] Inventors: Geoffrey I. Gray, Chester, N.Y.; John O. Freeborn, New Fairfield, Conn.

[73] Assignee: International Paper Company, New York, N.Y.

[21] Appl. No.: 802,576

[22] Filed: Jun. 1, 1977

[51] Int. Cl.[3] ..... H05B 3/00

[52] U.S. Cl. ..... 219/345; 252/510; 219/528; 219/549; 219/212; 219/527; 338/225; 338/223

[58] Field of Search ..... 219/345, 549, 548, 553, 219/528, 443, 211, 212; 252/510, 511; 174/121 R

[56] References Cited

U.S. PATENT DOCUMENTS

| | | | |
|---|---|---|---|
| 2,610,286 | 9/1952 | Cox | 219/212 |
| 2,634,361 | 4/1953 | Reynolds | 219/544 |
| 2,859,504 | 1/1975 | Motokawa et al. | 219/345 |
| 2,951,817 | 9/1960 | Meyers | 252/511 |
| 2,963,565 | 12/1960 | Moore et al. | 219/443 |
| 3,168,617 | 2/1965 | Richter | 219/549 |
| 3,543,005 | 11/1970 | Kelemen | 219/494 |
| 3,564,206 | 2/1971 | Lauck | 219/501 |
| 3,657,516 | 4/1972 | Fujihara | 219/345 |
| 3,664,013 | 5/1972 | MacGuire | 219/345 |
| 3,749,886 | 7/1973 | Michaelsen | 219/528 |
| 3,808,403 | 4/1974 | Kanaya et al. | 219/212 |
| 3,839,134 | 10/1974 | Fujihara | 161/62 |
| 3,900,654 | 8/1975 | Stinger | 219/528 |
| 3,923,697 | 12/1975 | Ellis | 252/510 |
| 3,935,422 | 1/1976 | Barnes et al. | 252/511 |

*Primary Examiner*—C. L. Albritton
*Assistant Examiner*—Bernard Roskoski
*Attorney, Agent, or Firm*—Finnegan, Henderson, Farabow, Garrett & Dunner

[57] ABSTRACT

The heating element includes a flexible graphite fiber-loaded impregnated paper saturated with a binder to ensure and maintain intimate electrical contact between the graphite fibers. In one form, two segments of the graphite fiber-loaded paper are coupled in series through a common bus bar and are electrically coupled to an SCR control circuit using a thermistor as a temperature responsive device. The graphite fiber-loaded paper with thermistor and electrical leads are encapsulated between cover sheets to provide an extremely thin highly flexible drapable therapeutic heating pad. Another form of heating pad includes providing the graphite fiber-loaded paper in the form of strips bonded to a plastic substrate. Electrical leads are attached and the substrate is enclosed by a cover sheet to provide a highly flexible heating pad. Two discrete methods of forming the latter heating pad are disclosed including silk screening and die pressing operations.

10 Claims, 13 Drawing Figures

HEATING ELEMENT AND METHODS OF MANUFACTURING THEREFOR

The present invention relates to heating elements and methods of manufacturing the same and particularly relates to therapeutic heating pads and manufacturing methods therefor.

Prior heating elements and particularly those for use in therapeutic heating pads are normally formed on insulated nichrome resistance wire helically wound on a suitable fiber string and insulated with a plastic covering. When current is applied, the resistive nature of the nichrome wire produces energy in the form of heat. Another technique uses an etched foil. It has been found that wire wound elements may be produced economically but are not particularly flexible whereas the etched foil pads are flexible but are not economical. Further, cotton linters are conventionally used as thick padding rendering the final heating pad bulky, flammable and ill-suited to conform to body contours.

Flexible printing inks or screen printing inks have been utilized to form the heating element in heating pads when loaded with sufficient resistive material. However, when loaded with sufficient resistive material to produce heat, these inks lose flexibility. Also, heating sheets formed of carbon or metallic substances deposited in a uniform layer on a semiflexible substrate, or woven fabrics loaded with resistive material and sintered usually do not produce uniform heat over the entire area and develop hot spots.

Further, in conventional heating pads, heat energy is generally controlled by bi-metallic switches which cycle between on and off positions resulting in heat fluctuation. These switches, as well as the nichrome resistance wire elements, have high profile and cross section. As a consequence, the conventional heating pad is bulky, does not readily conform to body contours, is not particularly flexible or drapable, and is conventionally fabricated from extremely flammable components.

The present invention provides a therapeutic heating pad and manufacturing methods therefor which eliminate or minimize the foregoing and other problems associated with prior heating pads and manufacturing methods therefor and provides a novel and improved therapeutic heating pad and manufacturing methods therefor having various advantages in construction, operation and use in comparison with such prior heating pads and manufacturing methods. Particularly, the present invention provides a thin highly flexible heating pad with excellent drape characteristics for ready conformance to body contours utilizing a thermistor SCR control to provide stable heat at adjustable temperatures. More particularly, the therapeutic heating pad according to the present invention includes a flexible graphite fiber-loaded or impregnated paper saturated with a binder to ensure and maintain intimate electrical contact between the graphite fibers. Preferably, two segments of the graphite fiber-loaded paper are connected in series in a common plane with a bus bar coupling the segments one to the other along one edge. A pair of bus bars are coupled to the segments along their opposite edges and, in turn, are coupled to an SCR control circuit using a thermistor as a temperature responsive device. The graphite fiber-loaded paper with thermistor and electrical leads attached is encapsulated between a pair of polyvinyl chloride sheets, preferably monomeric plasticized polyvinyl chloride, providing an extremly thin, highly flexible, drapable, therapeutic heating pad.

In another form of the present invention, the pad is fabricated to provide a continuous coherent electrical circuit pattern, which serves as the heating element, on a flexible substrate. For example, and by processes to be described hereinafter, a pattern consisting of a continuous strip of graphite loaded or impregnated paper is disposed on a flexible plastic substrate with a suitable cover sheet.

One method of forming a therapeutic heating pad having the continuous coherent electrical circuit pattern impressed or embossed on a flexible substrate includes etching a thin sheet of flexible plastic material in the form of the discrete circuit pattern, for example by a silk screening process. Once etched, a sheet of graphite fiber-loaded or impregnated paper is disposed over the substrate. The silk screen is then registered over the substrate and graphite-loaded paper, similarly as its earlier registration, and a binder is silk screened onto the paper and substrate. The binder, such as plastisol, bonds the electrically conductive sheet and substrate one to the other in the areas of the desired electrical heating pattern. After heating and curing, excess graphite fiber loaded material is removed from the substrate by jetting or blowing air over the surface leaving the substrate with the discrete continuous electrical circuit pattern bonded thereto. A thin flexible cover sheet is then applied over the circuit pattern on the substrate thus forming a highly flexible drapable heating pad with an encapsulated integral discrete heating element circuit pattern embossed therein.

Another method of forming a therapeutic heating pad having a discrete continuous electrical circuit pattern formed therein in accordance with the present invention includes providing a sheet of plastic material on a fixed surface underlying a movable heated press platen. The movable platen has raised areas in the pattern of the electrical circuit used as the heating element for the heating pad. The graphite filament loaded sheet is then disposed over the fixed substrate and the platen lowered onto the paper. Upon application of heat and pressure, the underlying plastic material of the substrate flows and bonds the graphite-loaded paper in the areas of the desired continuous circuit pattern to the substrate. Once cooled, the excess paper sheet material on the substrate may be air jetted or otherwise removed. As in the prior embodiment, a cover sheet is then applied to the heating element embossed substrate resulting again in a highly flexible drapable therapeutic heating pad.

Accordingly, it is a primary object of the present invention to provide a novel and improved highly flexible, drapable heating element and novel and improved methods of fabricating the same.

It is another object of the present invention to provide a novel and improved therapeutic heating pad having increased flexibility and drapability and novel and improved methods of fabricating the same.

It is still another object of the present invention to provide a novel and improved highly flexible and drapable therapeutic heating pad in which such characteristics are maintained throughout the life of the pad notwithstanding the otherwise normally degrading effects of heat and flexion and novel and improved methods of fabricating the same.

It is a further object of the present invention to provide a novel and improved therapeutic heating pad which combines in a single pad characteristics of safety, flexibility, conformability to body contours, and rapidity of manufacture.

It is a still further object of the present invention to provide novel and improved methods of manufacturing the foregoing therapeutic heating pad utilizing a graphite filament loaded cellulose fabric as the resistance material.

It is a related object of the present invention to provide a novel and improved method of manufacturing a therapeutic heating pad having the foregoing characteristics and wherein a continuous coherent heating element pattern is produced on a highly flexible substrate by a screen printing process.

It is a still further related object of the present invention to provide a novel and improved method of fabricating a therapeutic heating pad wherein graphite filament loaded paper under application of heat and pressure in a pressing operation is bonded to a flexible plastic substrate thereby forming a heating element in a continuous coherent pattern in the substrate.

To achieve the foregoing objects and in accordance with the purpose of the invention, as embodied and broadly described herein, a heating pad of this invention comprises a pair of sheet-like segments each formed of a paper sheet containing a predetermined percentage of graphite filaments and saturated with a plastisol containing a plasticizer, a pair of cover sheets disposed on opposite sides of and bonded to the segments, and electrical circuit means for applying current to the graphite fiber containing segments and resistively heating the pad including means for electrically coupling the segments in series one with the other and means for controlling current in the segments in response to variations in temperature in the heating pad thereby to maintain the resistive heat output at a predetermined temperature. Preferably the segments are substantially rectilinear with the electrical coupling means including an electrically conductive tape disclosed along like end edges of the segments electrically coupling the segments one to the other.

To form the foregoing described heating pad, a method of fabrication in accordance with the present invention includes providing a continuous sheet containing electrically conductive material, saturating the sheet with a thermoplastic material to bind the electrically conductive material within the sheet and maintain electrical conductivity across the sheet, curing the sheet bound with the thermoplastic material, forming a pair of segments from the sheet, electrically coupling the segments one to the other in series, and providing an electrical control circuit for the segments including a temperature responsive switching device.

Also, to achieve the foregoing objects and in accordance with the present invention as embodied and broadly described therein, the heating pad hereof may comprise a substrate formed of a flexible plastic material, a paper strip containing a predetermined percentage of graphite fibers, means bonding the strip and the substrate one to the other with the strip arranged in a predetermined continuous electrical circuit pattern on the substrate, at least one cover sheet disposed on the substrate, and electrical circuit means for applying current to the graphite fiber containing strip and resistively heating the pad.

To form the latter described heating pad, a method of fabrication thereof in accordance with the present invention includes providing a predetermined electrical circuit pattern on a base, disposing a continuous sheet containing electrically conductive material in juxtaposition to the electrical circuit pattern on the base, providing a plastic material in juxtaposition to the electrical circuit pattern on the base, bonding the sheet to the plastic material in the electrical circuit pattern, and removing the excess of the sheet not bonded to the plastic material in the electrical circuit pattern from the plastic material.

These and further objects and advantages of the present invention will become more apparent upon reference to the following specification, appended claims and drawings wherein:

FIG. 1 is an exploded perspective view of a therapeutic heating pad constructed in accordance with the present invention and illustrated with parts broken out and in cross section for clarity;

FIGS. 2A and 2B constitute a flow diagram illustrating various steps for fabricating the heating pad illustrated in FIG. 1;

Figure 1:
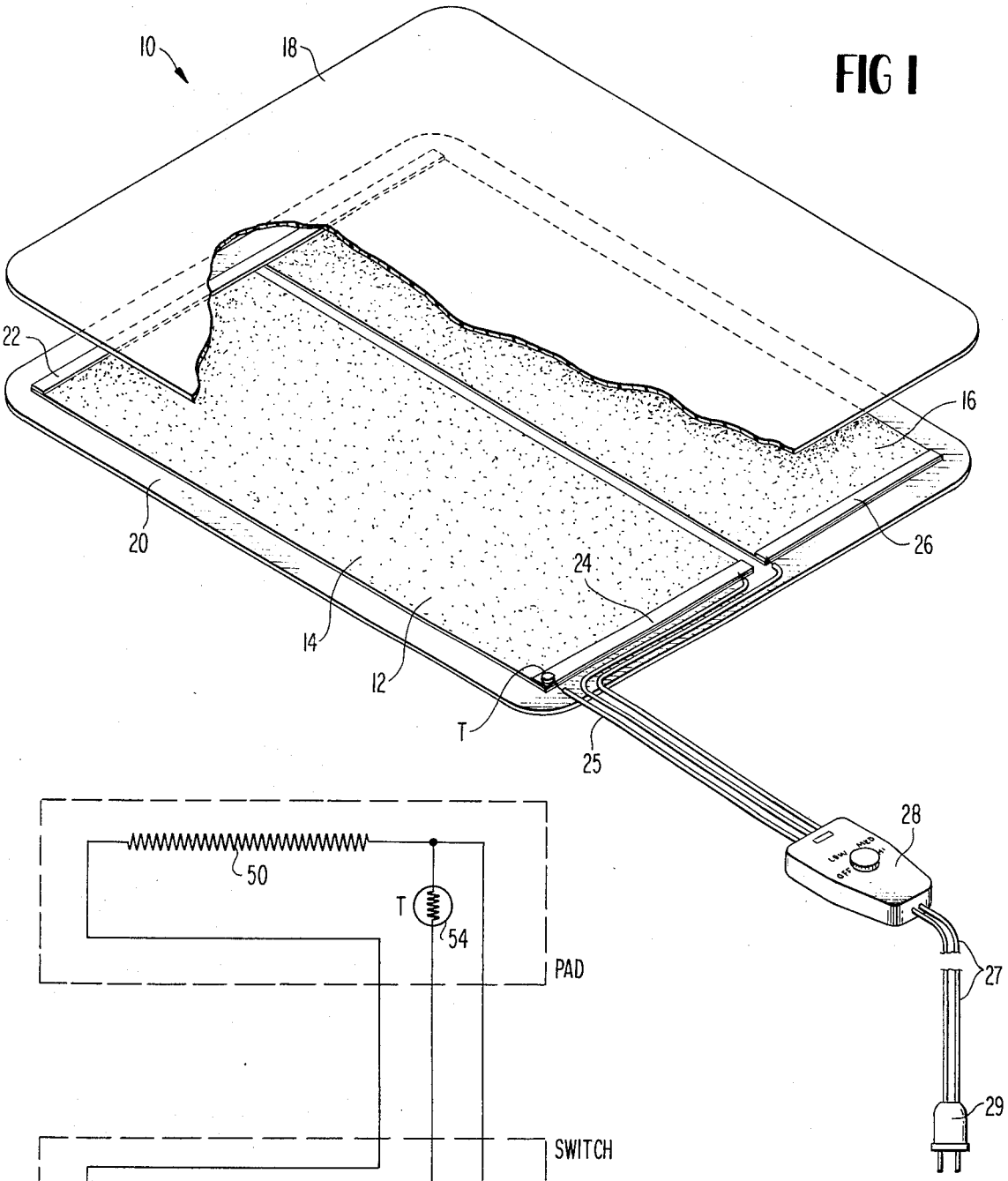

Referring now to FIG. 1, a heating element constructed in accordance with the present invention and in this instance a therapeutic electrical heating pad, is generally designated 10. Pad 10 includes an internal electrically conductive fabric or paper sheet 12 divided into two flat, generally rectangular, laterally spaced, sheet segments 14 and 16 for reasons which will become apparent from the ensuing description. Paper segments 14 and 16 are sandwiched or laminated between a pair of cover sheets 18 and 20. A bus bar 22 electrically interconnects segments 14 and 16 along ends while the opposite ends of segments 14 and 16 are provided with discrete bus bars 24 and 26, respectively. In the illustrated and preferred form, a thermistor T is fixed to bus bar 24 and thermistor leads 25 extend from bus bar 24 to a temperature control switch designated 28. A line cord and plug for the heating pad 10 are indicated at 27 and 29, respectively and are electrically connected to switch 28 in the usual manner.

More particularly, electrically conductive sheet 12 may comprise a nonwoven fabric of any heat stable fibers containing a predetermined percentage of graphite fibers fully saturated with a plastisol containing a plasticizer. The fabric may, for example, comprise a paper formed of hardwood pulp or polyester fibers or extremely high temperature resistant fibers, such as Kynol, and certain percentages of graphite filaments which serve as resistance elements and produce heat upon application of a specified voltage. Preferably, sheet 12 is produced from unbeaten hardwood pulps on standard paper making machinery, for example a Fourdrinier paper making machine, with a predetermined percentage of graphite fibers added. The graphite fibers provide electrical conductivity across the paper, the resistance of which paper can be altered as desired by changing the percentage of graphite fibers added, by using graphite fibers having greater or less conductivity, by changing the length of the graphite fibers or by various combinations of the foregoing. The graphite fiber-loaded sheet, when fabricated, has very little strength, is not cohesive, and is easily disintegrated.

Sheet 12 is saturated with a thermoplastic material, preferably polyvinyl chloride plastisol. The plastisol may be of the type manufactured by Stauffer Chemical Company and designated Plastisol 50–70, this particular plastisol having a vinyl-chloride-vinyl acetate copolymer plasticizd with dioctylphthalate. The plastisol, when added, binds the graphite filaments in the paper sheet, thereby providing strength to the paper sheet, and providing a medium to which the top and bottom cover sheets may be chemically bonded by application of heat as set forth in more detail hereinafter.

The bus bars 22, 24 and 26 may be formed of a suitable woven copper fabric of minimum thickness to ensure flexibility of the heating pad. Since an object of this invention is to provide a heating pad which is flexible and drapable, it will be appreciated that bus bars formed of metal bars or strips unless of thin mesh screen or foil thickness, could not be utilized. Preferably, a 0.003 inch thick quilted copper foil tape with a nonconductive pressure sensitive adhesive is utilized. A tape of this type is manufactured by the 3M Company and identified as Tape No. 1245. When tape of this type is applied under pressure to sheet 12, the deformations of the quilting are forced through the pressure sensitive adhesive and make intimate electrical contact with the graphite fibers in sheet 12 thus achieving excellent electrical connection between the bus bars and sheet 12.

Cover sheets 18 and 20 are each formed of polyvinyl chloride, preferably a monomeric plasticized polyvinyl chloride, approximating 20 mil. thickness. Monomeric plasticized polyvinyl chloride is preferred to avoid leaching out or ablation when the sheets are placed in environments which would cause degradation of the cover sheets. For example, heat and ultraviolet radiation would normally degrade many types of plastic materials over a period of time. This particular cover material avoids increasing the brittleness of cover sheets over time and ensures long term flexibility and drapability. These sheets are thermally bonded to electrically conductive paper sheet 12 wherein a very thin, highly flexible and drapable, heating pad is formed.

Figure 2A:
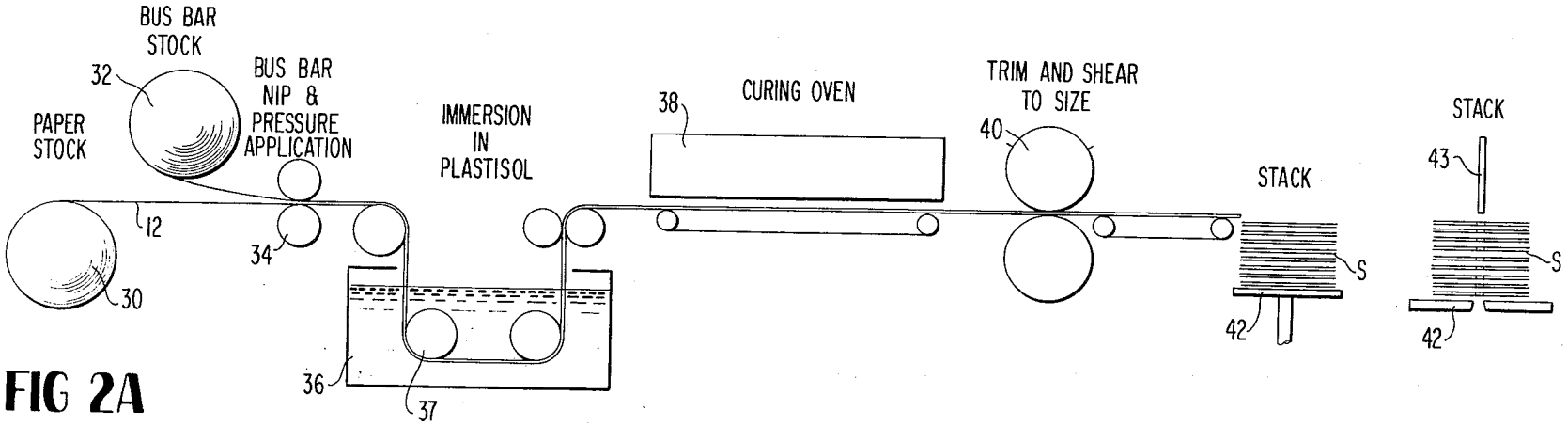
Figure 2B:
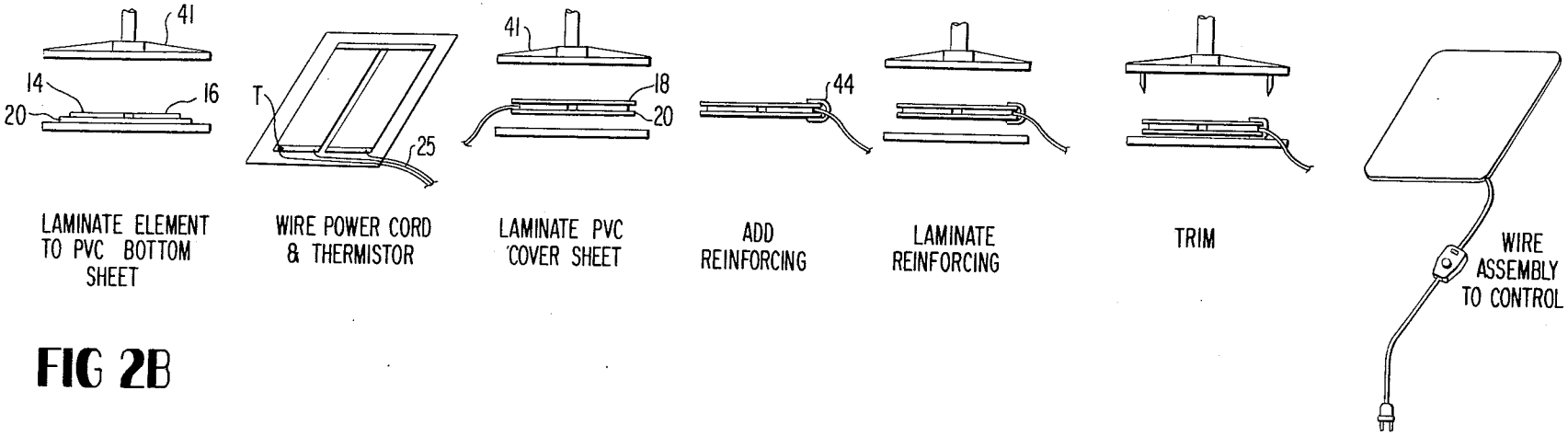

Referring now to FIGS. 2A and 2B, there is illustrated a preferred method of fabricating the therapeutic heating pad illustrated in FIG. 1. Particularly, the method includes providing the electrically conductive woven fabric or paper sheet 12 and bus bar tape on stock rolls 30 and 32 respectively. As the paper is taken off roll 30, the bus bar tape is applied along opposite lateral or end edges of paper 12 by transporting both the paper and bus bar tape between a pair of pressure rolls 34. As noted previously, the paper edges and tapes, when pressed together, form intimate electrical contact one with the other.

The paper with bus bar tapes applied is then immersed in a plastisol bath 36 about suitable rollers 37. The plastisol thus fully saturates the electrically conductive sheet 12. Upon emergence from the plastisol bath 36, the paper stock with bus bar tapes applied is passed through a curing oven 38. After curing, it will be appreciated that the plastisol non-chemically bonds the theretofore unbound graphite fibers in the paper or fabric sheet maintaining relative fiber orientation and electrical contact one with the other while maintaining the desired flexibility of the sheet. The combined cured paper and bus bar stock is then trimmed to predetermined size by a shearing roller 40 with the individual sheets being stacked as indicated at 42.

After a selected number of sheets S are stacked, the stack is registered below a die cutter 43. The die cutter 43 cuts or punches through the stacked sheets S along a median and through the bus bar tape at one end of the sheets S. The bus bar tape at the opposite end remains unsevered thus forming a pair of sheets or segments 14 and 16 connected one to the other through bus bar tape 22 along one edge of sheets S. As indicated in FIG. 2B, segments 14 and 16 are disposed below a heated press platen 41 and thermally and chemically bonded to the monomeric plasticized polyvinyl chloride bottom sheet 20 by a suitable heat pressing or laminating operation of known construction. After the electrically conductive plastisol saturated and cured segments 14 and 16 are thermally bonded to bottom sheet 12, thermistor T and the power chord leads 24 extending therefrom and bonded to bus bar tapes 24 and 26. Thermistor T may be either soldered to bus bar tape 24 or secured thereto by commercially available electrically conductive epoxy. Cover sheet 18 is then similarly thermally bonded to segments 14 and 16. It will be appreciated that segments 14 and 16, bus bar tapes 22, 24, 26, thermistor T, and thermistor leads 25 are sandwiched between the polyvinyl chloride cover sheets 18 and 20. One or more suitable vinyl reinforcing edges 44 may be applied about the edge or edges of the laminated heating pad to reinforce it particularly where the thermistor and other leads 25 extend from the bus bars 24 and 26 for connection with switch 28. The edges of the pad are then trimmed and the SCR control unit is attached to the leads 25.

Figure 3:
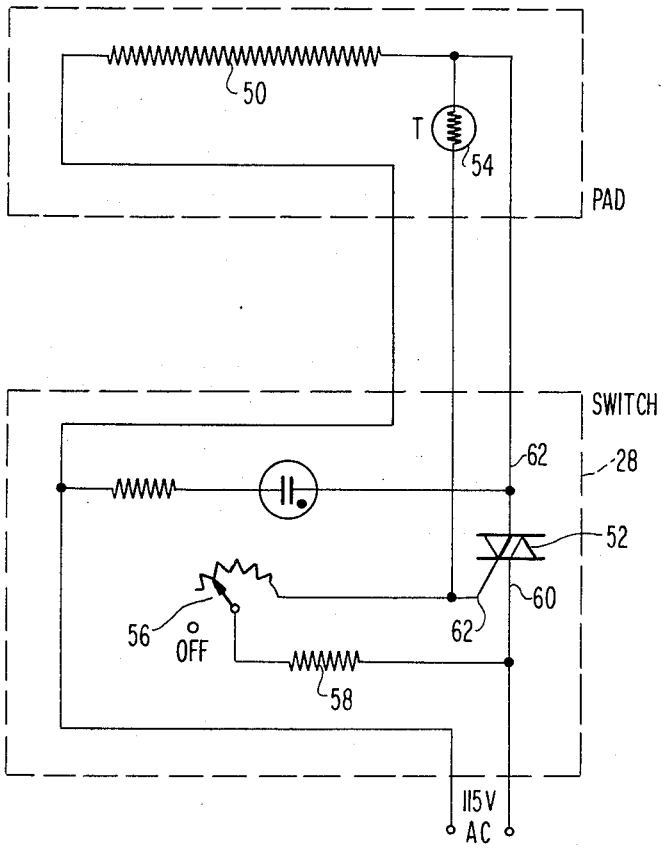
FIG. 3 is an electrical schematic of a heater control circuit for the heating pad illustrated in FIG. 1.

Referring now to FIG. 3, there is illustrated an electrical circuit for the heating pad hereof. The heating circuit and control for the circuit illustrated in FIG. 3 is built into the heating pad and switch. The source of power for the circuit can be from a standard 115 volt AC outlet. The primary heating element for the pad is the graphite fiber-loaded serially connected segments 14 and 16 illustrated unitarily as resistance 50 and which radiates heat, thereby increasing the temperature of the pad, dependent upon the current in the circuit.

Control of the current flow through resistance 50 is effected by the control circuit including SCR 52, a thermistor 54 and a variable resistance provided by resistors 56 and 58. More specifically, a controlled switching element, such as SCR 52, has its terminals 60 and 62 respectively connected to the power source and heating element 50. SCR 52 will be in a conductive or non-conductive state dependent upon the voltage applied to gate terminal 62. When SCR 52 is in a conductive state, current flows in the heating element 50 raising the temperature of the pad, and when it is in a non-conductive state, current is blocked from element 50 allowing the temperature of the pad to decrease.

In the present embodiment, thermistor 54 is connected between gate 62 and the junction of terminal 62 with heating element 50. Also connected to gate 62 is variable resistance 56 which is in series with fixed resistance 58. The second end of fixed resistance 58 is connected to terminal 60 of SCR 52.

During operation the switch controlling variable resistor 56 is adjusted to a resistive value which causes a voltage to be applied to gate 62 above some threshold value thereby placing SCR 52 in a conductive state. Current will flow through heating element 50 which will radiate heat from the pad. Since thermistor 54 is physically located within the pad, the resistance of thermistor 54 will decrease as the pad heats up. As the resistance of thermistor 54 decreases, the voltage required at gate 62 to fire SCR 52 will increase. But the voltage applied at gate 62 is fixed by the setting of resistance 56. When the required threshold voltage increases above the voltage determined by the setting of the variable resistance 56, SCR 52 becomes nonconductive. Current no longer will flow through heating element 50 and the temperature of the pad will decrease. As the temperature of the pad decreases the resistive value of thermistor 54 will increase thereby lowering the voltage required to fire SCR 52. At some given temperature the resistance value of thermistor 54 will be such that the threshold voltage required to fire SCR 52 will be below that determined by the setting of resistance 56. The SCR will again become conductive and current will flow through heating element 50. The cycle will repeat itself maintaining the temperature of the pad in some range dependent on the setting of the variable resistance 56.

In another embodiment hereof, a pair of the heat producing sheets having different graphite percentages may be disposed in a single heating pad to provide a multiple heat unit. For example, different graphite loadings in the paper segments will produce different heat for a given applied voltage. A segment of electrically conductive paper described hereinbefore containing a 10% loading of graphite filaments may produce a temperature of 49° C. while a similar sheet with 20% graphite filaments may produce a heat of 83° C., both at 110 volts A.C. Preferably, the segments are superposed one over the other separated by an insulating sheet and joined electrically in series. These layers are then bonded between a pair of cover sheets.

The temperature in this unit is controlled by a thermistor forming an integral part of the heating pad and which in turn is controlled by a conventional electrical circuit. Consequently, by proper switching, the sheet containing the 10% graphite filaments can produce, for example heat of 40° C. while the sheet containing the 20% graphite can produce, for example, heat of 83° C. Both may be switched on in series to produce, for example, heat of about 39° C. That is, a standard, commercially available, electrical heating pad control circuit can be coupled to the paired sheets with lo, medium and hi switch positions, not shown, corresponding to application of current through one, the other or both of the sheets of different graphite loadings whereby a three-heat heating pad can be provided.

Figure 4:
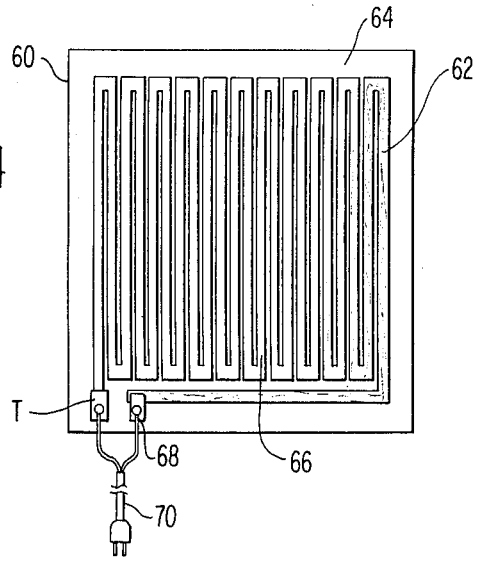
FIG. 4 is a plan view of another form of heating pad illustrating a continuous coherent heating element pattern therein.

Referring now to FIG. 4, there is illustrated a heating pad having a continuous circuit pattern impressed on a flexible substrate. The heating pad 60 illustrated in FIG. 4 has a continuous circuit pattern 62 on a substrate 64, the circuit pattern, in the illustrated form, consisting of an elongated continuous strip 66 of the previously described graphite fiber-loaded paper extending in generally parallel rows with ends of alternate adjacent rows connected one to the other. The opposite ends of the strip are connected to a thermistor T and electrical lead 68 is, in turn, coupled through a suitable switch, not shown, to a power cord 70. Other circuit patterns may be provided, for example W or U-shaped patterns can be formed as well as many others depending upon the heating requirements.

Figure 5A:
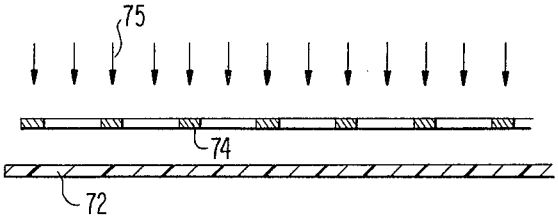
FIGS. 5A–5E are vertical cross sectional views illustrating a method of fabricating the heating pad illustrated in FIG. 4 utilizing a silk screening process.

Two illustrative methods of forming a heating pad having a continuous circuit pattern impressed on a substrate are described and illustrated herein in FIGS. 5A–5E and FIGS. 6A–6C respectively. Particularly, and referring to FIGS. 5A–5E, a thin sheet 72 of flexible, etchable, plastic material, for example, and preferably, a very low durometer polyether based urethane, is provided. Sheet 72, for example having a thickness on the order of 1/32 inch, is prepared to receive the coherent circuit pattern by initially wiping or spraying with a solvent, such as acetone, to produce a slightly tacky surface. A silk screen 74, in the heating element pattern is also provided by any suitable known process. For example, the desired pattern such as shown in FIG. 4 can be laid on clear mylar with tape and photographed. The resulting picture can be transferred to the silk screen by an etching process. The silk screen containing the cohesive circuit pattern is then registered over the substrate 72 as illustrated in FIG. 5A. A binder 75, having adhesive qualities, is then silk screened onto the urethane substrate in the heating element pattern. The silk screened binder may comprise a suitable solvent, which attacks the substrate whereby the coherent electrical pattern is etched onto the substrate surface.

Figure 5B:
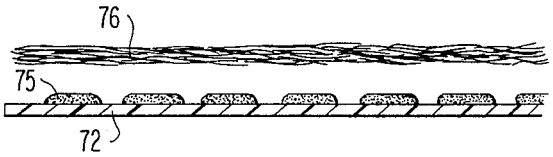
Figure 5C:
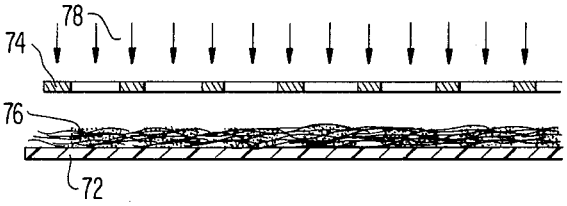

While the substrate is still wet, a nonwoven graphite fiber impregnated, preferably cellulose, fabric or paper sheet 76, such as described previously, is then laid on the urethane substrate as illustrated in FIG. 5B. While maintaining registration of the silk screen 74 over the binder in the electrical pattern on the substrate and the electrically conductive sheet, a plastic material 78 is silk screened onto sheet 76 and substrate 72. Preferably, a plastic material 78, such as plastisol, is used which bonds the electrically conductive sheet 76 and the substrate 72 one to the other in the desired electrical heating pattern. The plastisol is absorbed by the sheet 76 only on the part exposed to the open portions of silk screen 72. The substrate 72, paper or fabric sheet 76, and plastisol 78 are then cured in a heated oven.

Figure 5D:
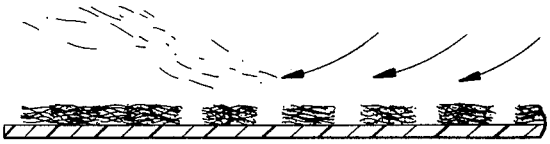
Figure 5E:
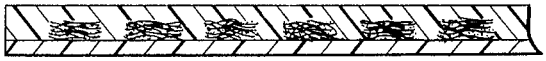

It will be appreciated that once the plastisol 78 is silk screened onto the electrically conductive sheet 76, the applied heat bonds the sheet 76 to the underlying substrate 72 only in those areas where the electrical circuit pattern is desired. That is, the plastisol completely saturates and flows through the electrically conductive sheet 76 only in those areas where the plastisol was applied through the silk screen 74. After heating and curing, it will thus be appreciated that the desired coherent continuous electrical pattern is bonded to the substrate. It will be recalled that the graphite cellulose material forming sheet 76 contains no binders and is thus not a cohesive structure, and is easily disintegrated. Consequently, the portion of the sheet 76 not bonded to substrate 72 may be removed by air or water jetting as illustrated in FIG. 5D. Alternatively, a suitable solvent such as copper complexed with ethylene diamine or a reagent such as hydrochloric acid which will destroy the cellulose without attacking the continuous graphite fiber-loaded paper strip silk screened onto the urethane substrate may be utilized. Once cured, the power cord is attached and the laminations thus formed may be covered by potting with urethane having a nominal thickness of about 1/32 inch.

Figure 6A:
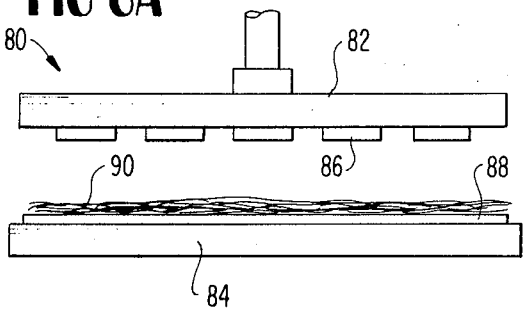
FIGS. 6A–6C are vertical cross sectional views illustrating another method for fabricating the heating pad illustrated in FIG. 4.
Figure 6B:
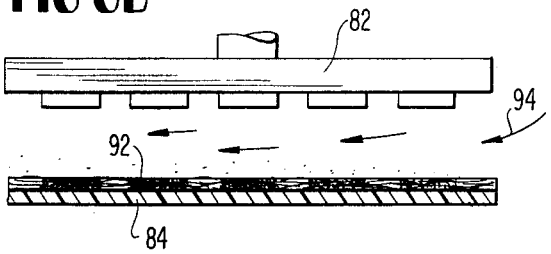
Figure 6C:
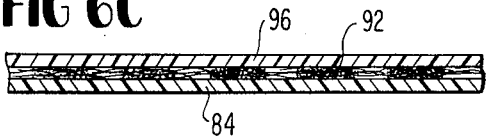

Referring now to FIGS. 6A–6C, there is illustrated another method of forming the flexible drapable heating pad illustrated in FIG. 4. In this embodiment of the present invention, a press 80 having at least one heated press platen 82 and a fixed or movable platen 84 are provided. Preferably, the movable press platen 82 has a predetermined continuous circuit layout formed on it in a pattern 86 raised from the platen surface. For example, this raised surface may correspond to the circuit strip 66 shown in FIG. 4. On the opposite platen, a thermoplastic material, such as polyurethane, PVC, polypropylene, polyethylene, etc., forming the substrate 88 is provided. An electrically conductive sheet 90, preferably formed of cellulose and graphite fibers as described with respect to the previous embodiments, is disposed over the thermoplastic substrate 88. When press 80 is closed and heated, the thermoplastic substrate 88 flows under pressure and portions of the electrically conductive sheet in the designated areas of the raised pattern flow are pressed into the substrate. The graphite fiber-laden paper thus coalesces with the flowing thermoplastic material 88 in the areas underlying the raised circuit pattern 86 formed on the platen 82. With the press remaining closed and the substrate and sheet remaining under pressure, the press is then cooled. It will be appreciated that the coalesced portions of the electrically conductive sheet are thus bonded to the substrate in areas 92 (FIG. 6B) corresponding to the raised circuit pattern on platen 82. After cooling, the press is opened and the residual or excess of the graphite fiber-laden sheet 90 overlying areas of substrate 84 other than in the designated pattern is loose and unbonded relative to the substrate. This loose material is then removed, for example by air blasting as illustrated by the arcuate arrows 94 in FIG. 6B.

A thermistor and electrical leads are then attached to the substrate at opposite ends of the embossed or impressed circuit pattern 92. Subsequently, a second sheet 96 of compatible thermoplastic material is placed on the substrate as illustrated in FIG. 6C covering the exposed circuit and the assembly is placed through a heated calender permanently bonding the substrate, continuous circuit pattern and cover sheet in a lamination.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. A heating pad comprising a pair of sheet-like segments each formed of a paper sheet containing a predetermined percentage of graphite fibers and saturated with a thermoplastic material;

a pair of flexible plastic cover sheets disposed on opposite sides of and thermally and chemically bonded to said segments by said thermoplastic, said segments being integral with said cover sheets, and electrical circuit means for applying current to said graphite fiber-containing segments and resistively heating said pad, including means for electrically coupling said segments in series one with the other and means for controlling current in said segments in response to variations in temperature in the heating pad for maintaining the resistive heat output at a predetermined temperature.

2. A heating pad according to claim 1 wherein said control means includes a thermistor.

3. A heating pad according to claim 1 wherein said thermoplastic material is dioctylphthalate.

4. A heating pad according to claim 1 wherein said electrical coupling means includes an electrically conductive tape disposed along respective edges of said segments.

5. A heating pad according to claim 1 wherein said segments lie in side-by-side substantially coplanar relation one to the other.

6. A heating pad according to claim 5 wherein said segments are substantially rectilinear, said electrical coupling means including an electrically conductive flexible tape disposed along like edges of said segments electrically coupling said segments one to the other.

7. A heating pad according to claim 1 wherein said control means includes a thermistor, said thermoplastic material is dioctylphthalate, and said electrical coupling means includes an electrically conductive tape disposed along respective edges of said segments.

8. A heating pad according to claim 1 wherein said segments lie in side-by-side substantially coplanar relation one to the other, said segments being substantially rectilinear, said electrical coupling means including an electrically conductive flexible tape disposed along like edges of said segments electrically coupling said segments one to the other, said control means includes a thermistor and said thermoplastic material is dioctylphthalate.

9. A heating pad comprising:

a substrate formed of a flexible plastic material, a paper strip containing a predetermined percentage of graphite fibers and saturated with a thermoplastic material, said thermoplastic material thermally and chemically bonding said strip and said substrate one to the other with said strip arranged in a predetermined continuous electrical circuit pattern in said substrate, at least one cover sheet disposed on said substrate, and electrical circuit means for applying current to said graphite fiber containing strip and resistively heating said pad.

10. A heating pad comprising:

at least one cover sheet formed of a flexible plastic material;

paper containing a predetermined percentage of graphite fibers and saturated with a thermoplastic material;

said thermoplastic material thermally and chemically bonding said paper and said cover one to the other, said paper forming a heating element integral with said cover sheet; and electrical current means for applying current to said graphite fiber-containing paper and resistively heating said pad, the electrical circuit means including means for controlling current in response to variations of temperature in the heating pad and including a thermistor for maintaining a resistive heat output at a predetermined temperature.

* * * * *